US008454332B2

(12) United States Patent
Genevois et al.

(10) Patent No.: US 8,454,332 B2
(45) Date of Patent: Jun. 4, 2013

(54) METHOD OF ASSEMBLING A REFRIGERATING COMPRESSOR

(75) Inventors: David Genevois, Cailloux Sur Fontaine (FR); Pierre Ginies, Sathonay Village (FR); Jean M Pfister, Millery (FR)

(73) Assignee: Danfoss Commercial Compressors, Trevoux (FR)

( * ) Notice: Subject to any disclaimer, the term of this patent is extended or adjusted under 35 U.S.C. 154(b) by 831 days.

(21) Appl. No.: 12/450,433

(22) PCT Filed: Apr. 14, 2008

(86) PCT No.: PCT/FR2008/050661

§ 371 (c)(1),
(2), (4) Date: Nov. 13, 2009

(87) PCT Pub. No.: WO2008/145888

PCT Pub. Date: Dec. 4, 2008

(65) Prior Publication Data

US 2010/0104460 A1 Apr. 29, 2010

(30) Foreign Application Priority Data

Apr. 25, 2007 (FR) ..... 07 02998

(51) Int. Cl.

| | |
|---|---|
| ***F03C 2/00*** | (2006.01) |
| ***F03C 4/00*** | (2006.01) |
| ***F04C 15/00*** | (2006.01) |
| ***F04C 2/00*** | (2006.01) |

(52) U.S. Cl.
USPC ..... 418/1; 418/55.1; 29/888.022

(58) Field of Classification Search
USPC ..... 418/1, 55.1–55.6, 57; 29/888.022
See application file for complete search history.

(56) References Cited

U.S. PATENT DOCUMENTS

| | | | | |
|---|---|---|---|---|
| 4,877,382 | A * | 10/1989 | Caillat et al. | 418/55.5 |
| 5,228,196 | A * | 7/1993 | Hara et al. | 29/888.02 |
| 5,564,186 | A * | 10/1996 | Hori et al. | 29/888.022 |
| 6,517,328 | B2 * | 2/2003 | Makino et al. | 417/410.1 |
| 7,708,536 | B2 * | 5/2010 | Ginies et al. | 418/55.1 |
| 2009/0035168 | A1 | 2/2009 | Ginies et al. | |
| 2009/0041602 | A1 | 2/2009 | Ginies et al. | |
| 2009/0110581 | A1 * | 4/2009 | Fontaine et al. | 418/55.1 |
| 2009/0252624 | A1 * | 10/2009 | Genevois et al. | 29/888.022 |

* cited by examiner

FOREIGN PATENT DOCUMENTS

| | | | |
|---|---|---|---|
| EP | 1 533 527 | A1 | 5/2005 |
| FR | 2 885 966 | A1 | 11/2006 |

OTHER PUBLICATIONS

International Search Report issued on Jan. 30, 2009 in the corresponding International Application No. PCT/FR2008/050661.

*Primary Examiner* — Theresa Trieu
(74) *Attorney, Agent, or Firm* — Oliff & Berridge, PLC

(57) ABSTRACT

A compressor comprising a sealed chamber delimited laterally by a shell, a drive shaft housed in the shell and guided relative to the other parts of the compressor via at least one bearing provided in a bearing support fixed to the internal wall of the shell. The method comprises steps consisting in supplying a shell have, in the fixing plane of the bearing support, an oval section comprising a small axis to which the bearing support is intended to be mounted, exerting a pressure on the shell in order to elastically deform it so as to increase the length of its small axis, inserting and positioning the bearing support in the fixing plane of the latter, and ceasing to exert a pressure on the shell so that the latter tends to elastically return to its original form and grip the bearing support.

10 Claims, 5 Drawing Sheets

METHOD OF ASSEMBLING A REFRIGERATING COMPRESSOR

BACKGROUND OF THE INVENTION

Description of the Prior Art

The present invention relates to a method of assembling a refrigerating compressor and to a refrigerating compressor.

Document FR 2 885 966 describes a refrigerating compressor comprising:

- a sealed chamber laterally delimited by a substantially cylindrical shell ring the two ends of which are closed by a cover and by a base, respectively,
- an electric motor housed in the shell ring, the electric motor comprising a stator, and a rotor secured to a drive shaft, the drive shaft being guided with respect to the other components of the compressor by at least one bearing created in a bearing support attached to the interior wall of the shell ring, near the base.

The purpose of the bearing support is to transmit to the shell ring of the compressor the loads applied to the bearing that guides the drive shaft.

The bearing support is attached to the shell ring by welding. Hence, the loads applied by the drive shaft to the bearing created in the bearing support are transferred to the shell ring via the various spot welds created.

As a result, the various spot welds are subjected to a fatigue cycle which means that they have to be dimensioned accordingly.

In addition, the reliability of the compressor is connected with the quality and cross section of the spot welds created. If the welds are inadequately dimensioned that will, after a period of operation, adversely affect the alignment of the bearings and thus the reliability of the machine.

One solution to avoid having to use welding to attach the bearing support to the shell ring might be to force fit the bearing support into the substantially cylindrical shell ring.

However, this force-fitting of the bearing support into the shell ring would lead to deformation of the shell ring in the plane of attachment of the bearing support. This would then result in out-of-roundness of the shell ring which would then allow debris to enter during the operation of welding the base of the compressor onto the corresponding end of the shell ring.

SUMMARY OF THE INVENTION

It is an aim of the present invention to overcome these disadvantages and an object of the invention to provide a method of assembling a refrigerating compressor which is simple and economical while at the same time allowing the bearing support to be attached firmly to the shell ring without giving rise to any out-of-roundness of the shell ring in the plane of attachment of the bearing support.

To this end, the present invention relates to a method of assembling a refrigerating compressor comprising a sealed chamber laterally delimited by a shell ring, a drive shaft housed in the shell ring and guided with respect to the other components of the compressor by at least one bearing created in a bearing support attached to the interior wall of the shell ring, which method comprises the following steps consisting in:

- supplying a shell ring which, in the plane of attachment of the bearing support, has a cross section of oval overall shape comprising a minor axis along which the bearing support is intended to be mounted, and a major axis, the length of the minor axis being less than the length of the bearing support measured along its longest dimension,
- applying pressure to the shell ring in order to deform it elastically in such a way as to increase the length of its minor axis,
- inserting the bearing support into the shell ring,
- positioning the bearing support in the plane of attachment thereof, along the minor axis of the shell ring,
- ceasing to apply pressure to the shell ring so that the latter has a tendency elastically to revert to its original shape and grips the bearing support, the zones of contact between the bearing support and the shell ring lying more or less on an arc of a circle of a diameter greater than the minor axis, the bearing support maintaining elastic deformation of the shell ring so that the latter exhibits a substantially circular cross section in the plane of attachment of the bearing support.

Thus, the bearing support is held firmly in the shell ring by the elasticity of the latter. This arrangement makes it possible to avoid creating spot welds of specific size, and therefore makes it possible to simplify the method of assembling the refrigerating compressor.

Furthermore, this method of attaching the bearing support into the shell ring makes it possible to maintain the roundness of the latter in the plane of attachment of the bearing support.

The method of assembly according to the invention allows the loads applied by the drive shaft to the bearing support to be transferred directly to the shell ring.

For preference, the bearing support is attached to the interior wall of the shell ring on a plane substantially perpendicular to the axis of the shell ring.

According to one embodiment of the invention, the step that consists in supplying a shell ring of oval overall cross section comprises the following steps:

- supplying a shell ring of substantially cylindrical shape, and
- permanently deforming the shell ring in such a way that it exhibits said cross section of oval overall shape in the plane of attachment of the bearing support.

According to another embodiment of the invention, the pressure applied to the shell ring is applied along the major axis of the shell ring, on each side of the minor axis thereof.

Advantageously, the method comprises a step that consists in creating at least one spot weld between the bearing support and the shell ring after the former has been positioned in the latter.

This spot weld is then created essentially to prevent the bearing support from shifting as a result of vertical loadings, for example when the latter is being moved around.

For preference, the method comprises the following steps, performed before the bearing support is positioned in the shell ring, and consisting in:

- attaching a stator of an electric motor inside the shell ring, the stator being mounted so that it is stationary with respect to the interior wall of the shell ring,
- attaching inside the shell ring a body that is intended to delimit an intake volume and a compression volume on each side thereof, a bearing intended to guide the drive shaft being created in the body,
- assembling the drive shaft in the bearing created in the body, attaching the rotor of the electric motor to the drive shaft.

Advantageously, the method comprises the following steps, performed after the bearing support has been positioned in the shell ring, and consisting in:

- attaching a compression stage inside the shell ring, the compression stage comprising a fixed volute equipped with a scroll engaged in a scroll of a moving volute driven in an orbital movement, attaching a cover to one of the ends of the shell ring, attaching a base to the other end of the shell ring.

According to one embodiment of the invention, the zones of contact between the bearing support and the shell ring are discontinuous.

The present invention also relates to a refrigerating compressor comprising:

a sealed chamber laterally delimited by a shell ring, an electric motor housed in the shell ring, the electric motor comprising a stator, and a rotor secured to a drive shaft, the drive shaft being guided with respect to the other components of the compressor by at least one bearing created in a bearing support attached to the interior wall of the shell ring, in which the zones of contact between the bearing support and the shell ring lie more or less on an arc of a circle, and in which, when the bearing support is in the non-assembled position, the shell ring has, in the plane of attachment of the bearing support, an oval overall cross section comprising a minor axis along which the bearing support is intended to be mounted, the length of the minor axis being less than the diameter of the arc of a circle on which the zones of contact between the bearing support and the shell ring lie.

For preference, the zones of contact between the bearing support and the shell ring are discontinuous.

DESCRIPTION OF THE DRAWINGS

In any event the invention will be clearly understood with the aid of the description which follows, given with reference to the keyed schematic drawing which, by way of nonlimiting example, depicts one embodiment of this scroll compressor.

DESCRIPTION OF THE PREFERRED EMBODIMENT(S)

Figure 7:
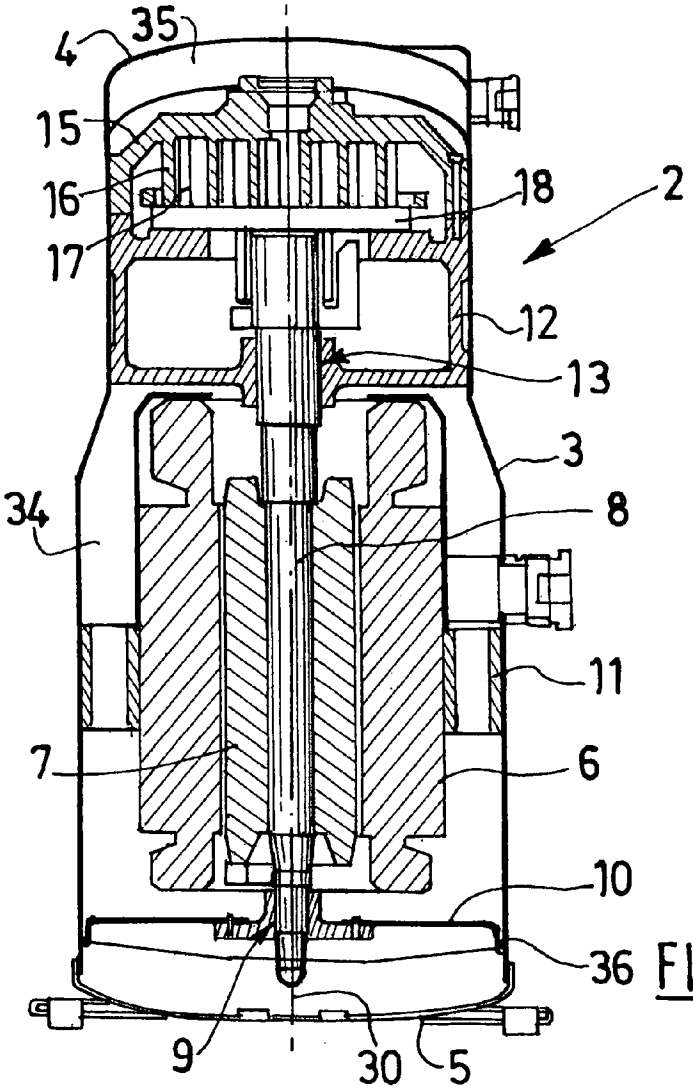
FIG. 7 is a view in longitudinal section of a refrigerating compressor according to the invention in the assembled state.

FIG. 7 depicts a scroll-type refrigerating compressor 2 according to the invention, comprising:

a sealed chamber laterally delimited by a shell ring 3 of which the two ends are closed by a cover 4 and a base 5, respectively, an electric motor housed in the shell ring, the electric motor comprising a stator 6 mounted so that it is stationary with respect to the shell ring at the middle of which there is positioned a rotor 7 secured to a drive shaft 8.

Figure 2:
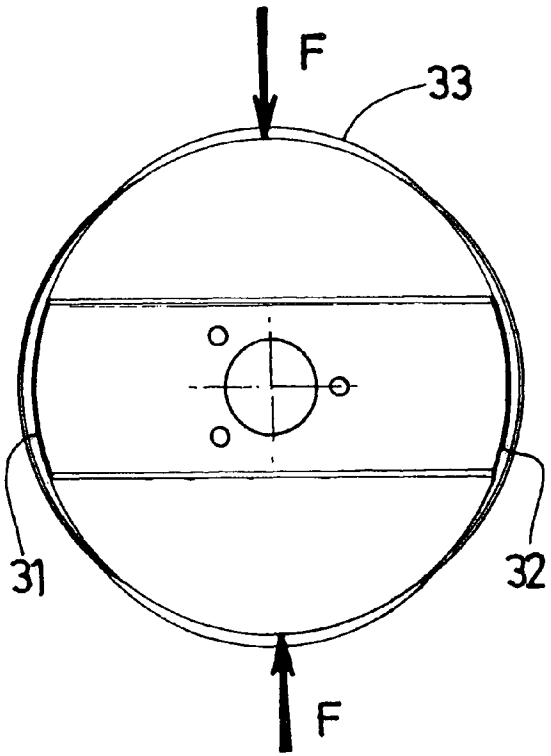

The drive shaft 8 is guided with respect to the other components of the compressor by at least one bottom bearing 9 created in a bearing support 10 of substantially rectangular shape. The bearing support 10 is attached to the interior wall of the shell ring, near the base 5, along an axis substantially perpendicular to the axis 30 of the shell ring 3. As shown in FIG. 2, the transverse edges 31, 32 of the bearing support 10 respectively extend along an arc of a circle 33.

The method of assembling this scroll compressor will now be described.

Figure 3:
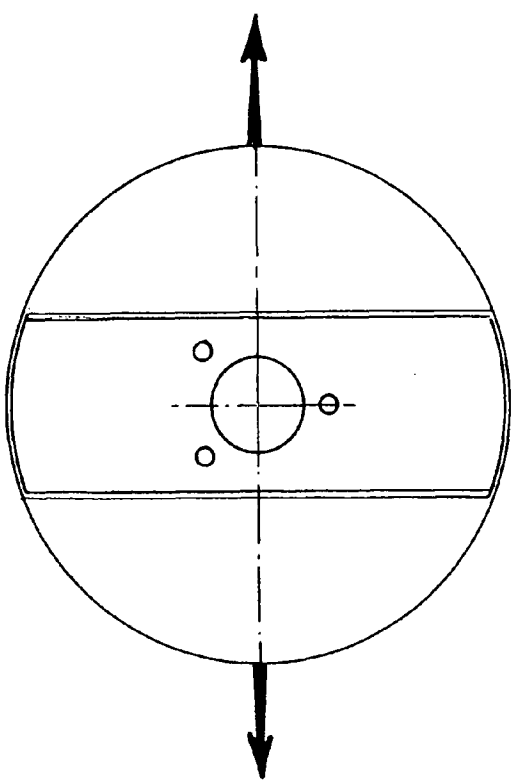
FIGS. 1 to 3 are schematic views from beneath depicting the steps of inserting and of positioning a bearing support in a shell ring according to the invention.
Figure 1:
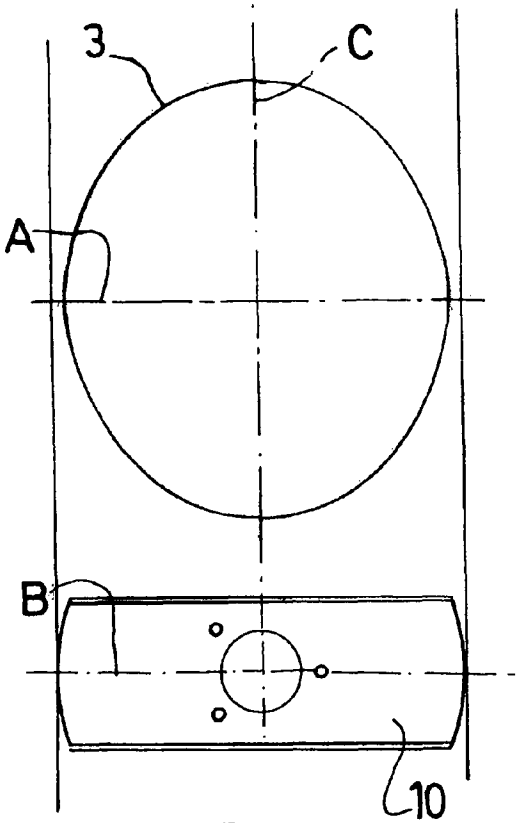
Figure 5:
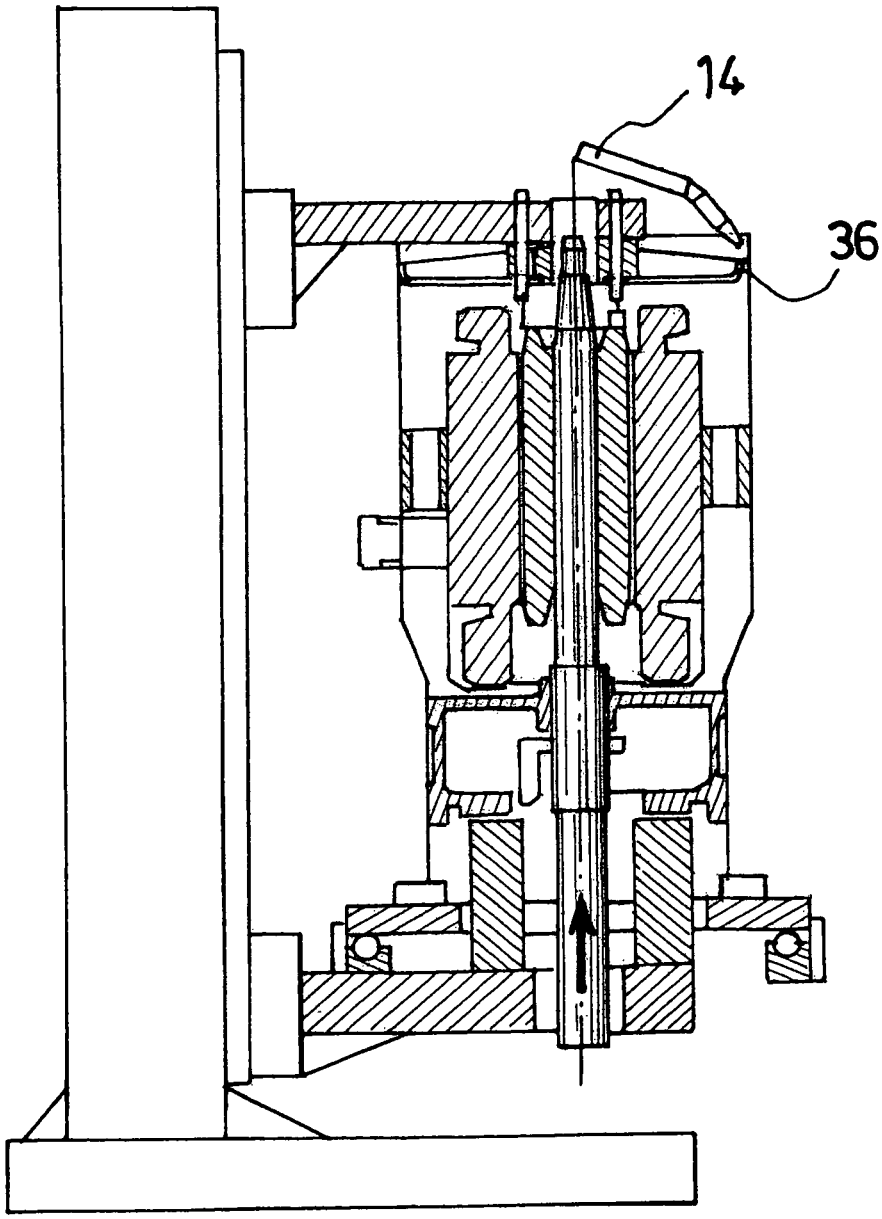
FIG. 5 is a view in longitudinal section showing the step of welding the bearing support to the shell ring.

The method of assembly according to the invention is depicted in FIGS. 1 to 8 and comprises the following steps consisting in:

supplying a shell ring 3 which, in the plane of attachment of the bearing support 10, has a cross section of oval overall shape comprising, as depicted in FIG. 1, a minor axis A along which the bearing support 10 is intended to be mounted, and a major axis C, the length of the minor axis A being less than the length of the bearing support measured along its longest dimension, that is to say along the axis B, attaching the stator 6 of the electric motor inside the shell ring 3 via a flange 11 encircling the stator and connected to the interior wall of the shell ring, attaching inside the shell ring 3 a body 12 that is intended to delimit an intake volume 34 situated below the latter and a compression volume 35 arranged above the latter, a bearing 13 intended to guide the drive shaft 8 being created in the body 12, assembling the drive shaft 8 in the bearing 13 created in the body 12, attaching the rotor 7 of the electric motor to the drive shaft 8, applying pressure to the shell ring along its major axis C and on each side of the minor axis thereof, that is to say in the direction of the arrows F depicted in FIG. 2, in order to deform it elastically in such a way as to increase the length of its minor axis A beyond the length of the bearing support 10 along the axis B, inserting the bearing support 10 into the shell ring 3, positioning the bearing support 10 in the plane of attachment thereof, the axis B of the bearing support 10 being substantially parallel to the minor axis A of the shell ring 3, ceasing to apply pressure to the shell ring so that the latter tends elastically to revert to its original shape and grips the bearing support 10, as has been depicted by two arrows in FIG. 3, creating at least one spot weld 36 between the bearing support and the shell ring after the former has been positioned in the latter, using a welding device 14, as depicted in FIG. 5, inserting and attaching the bearing 9 on the bearing support 10 in order to position the drive shaft 8, attaching a compression stage to the body 12 separating the intake 34 and compression 35 volumes, the compression stage comprising a fixed volute 15 equipped with a scroll 16 engaged in a scroll 17 of a moving volute 18 driven in an orbital movement by the drive shaft 8, using welding to attach the cover 4 to the top end 37 of the shell ring 3, using welding to attach the base 5 to the bottom end 38 of the shell ring 3.

It should be noted that the zones of contact between the bearing support 10 and the shell ring 3 lie on an arc of a circle 33 of a diameter greater than the minor axis A of the shell ring and that the bearing support 10 maintains elastic deformation of the shell ring 3 such that it exhibits a circular cross section in the plane of attachment of the bearing support.

It should also be noted that the step that consists in supplying a shell ring 3 of oval overall cross section involves the following steps:

supplying a shell ring 3 of substantially cylindrical shape, and permanently deforming the shell ring 3 in such a way that it exhibits said cross section of oval overall shape in the plane of attachment of the bearing support 10.

Figure 4:
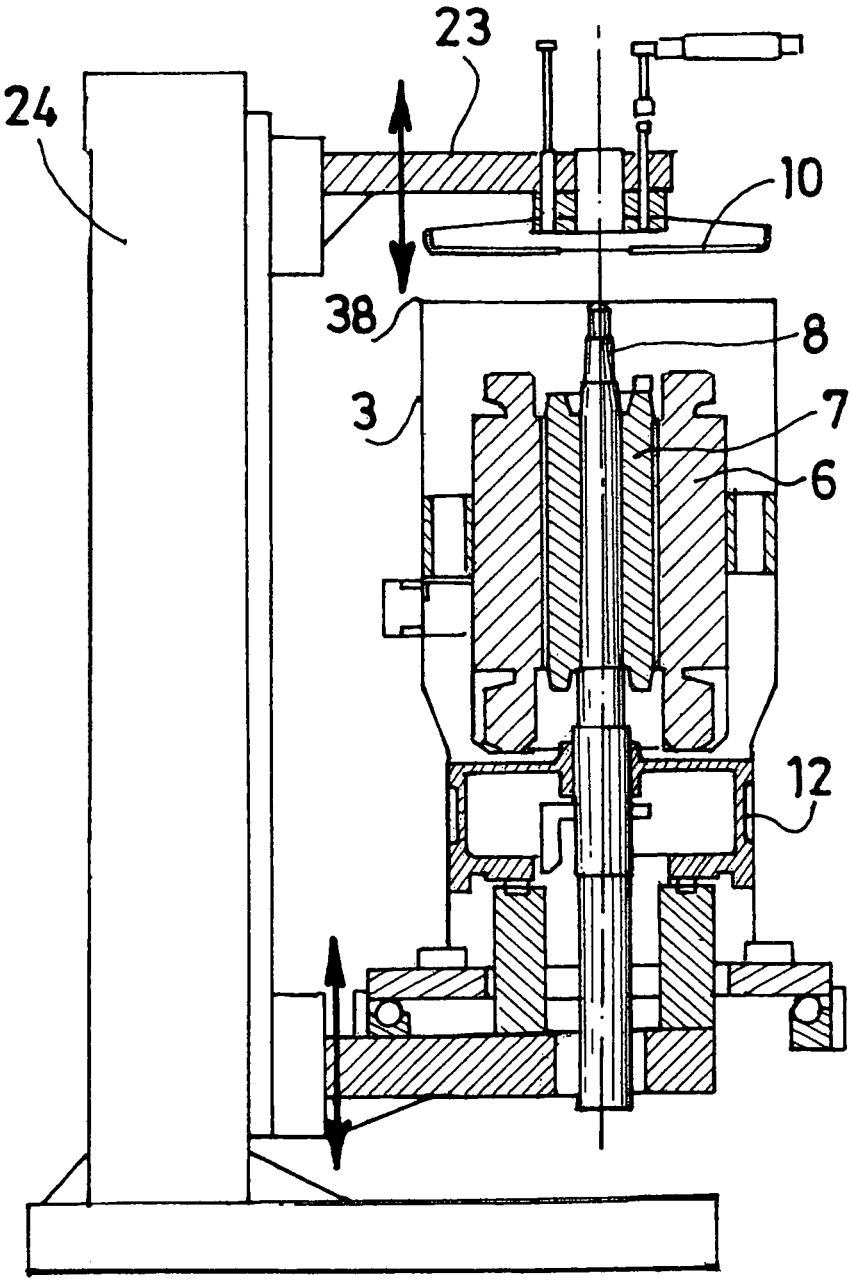
FIG. 4 is a view in longitudinal section showing the step of inserting the bearing support into the shell ring.

In addition, the steps that consist in inserting and positioning the bearing support 10 in the shell ring 3 comprise the following steps that consist in:

screwing the bearing support 10 onto an arm 23 mounted such that it can move in terms of vertical translation with respect to a support chassis 24, as has been shown in FIG. 4, moving the arm 23 vertically downward so as to introduce the bearing support 10 into the shell ring 3 and so as to position the bearing support 10 in its plane of attachment, and ceasing to apply pressure to the shell ring 3 so that the latter tends elastically to revert to its original shape and grips the bearing support 10, as has been depicted in FIG. 3, unscrewing the bearing support 10 from the arm 23.

Figure 6:
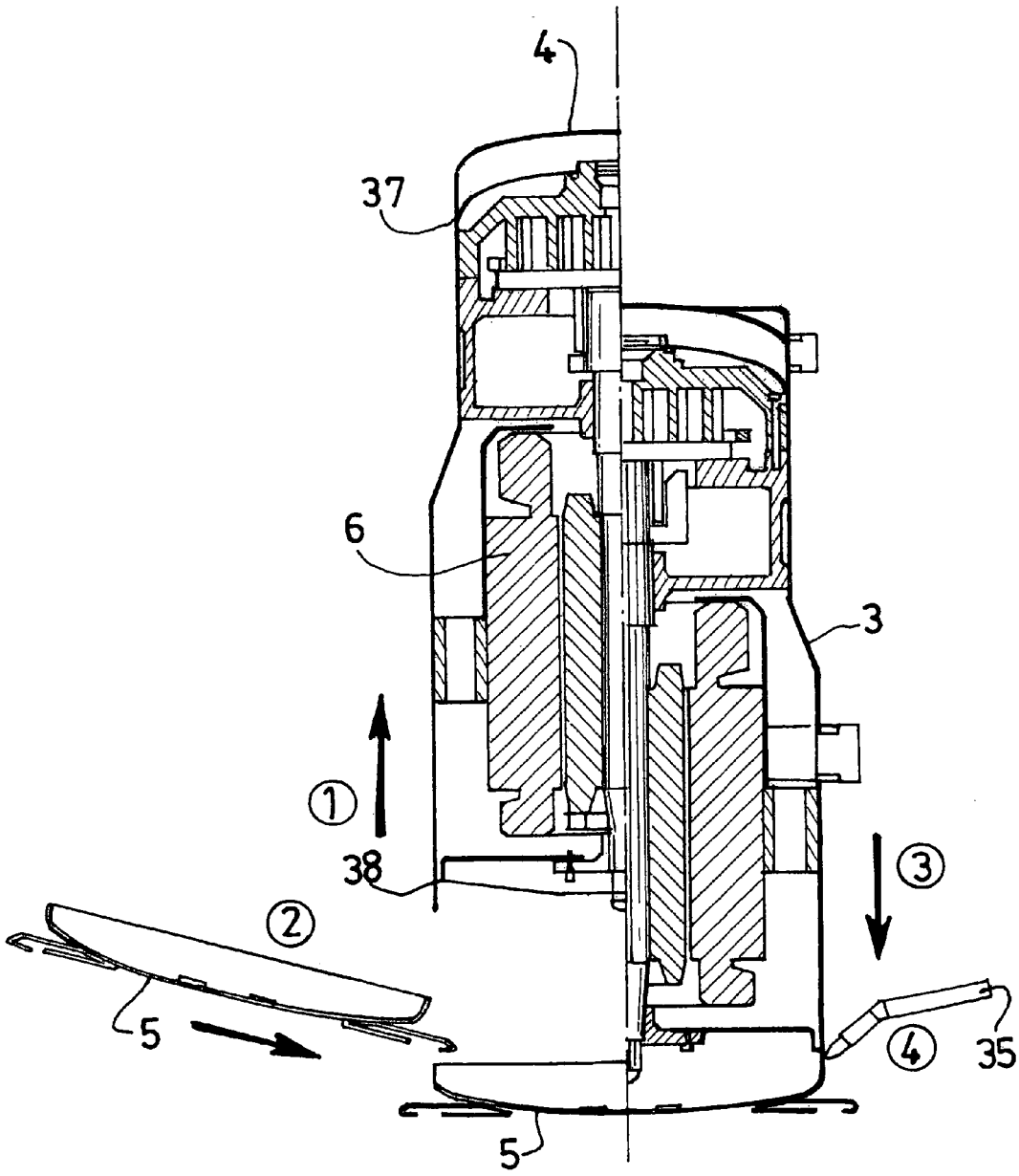
FIG. 6 is a view in longitudinal section showing the step of welding the base of the compressor to the shell ring.

Furthermore, as has been depicted in FIG. 6, the step of attaching the base 5 to the bottom end of the shell ring 3 comprises the following steps which consist in:

1) lifting up the shell ring 3, 2) positioning the base 5 underneath the shell ring 3, 3) inserting the shell ring 3 in the base, and 4) welding the base 5 to the shell ring using a welding device 25.

Figure 8:
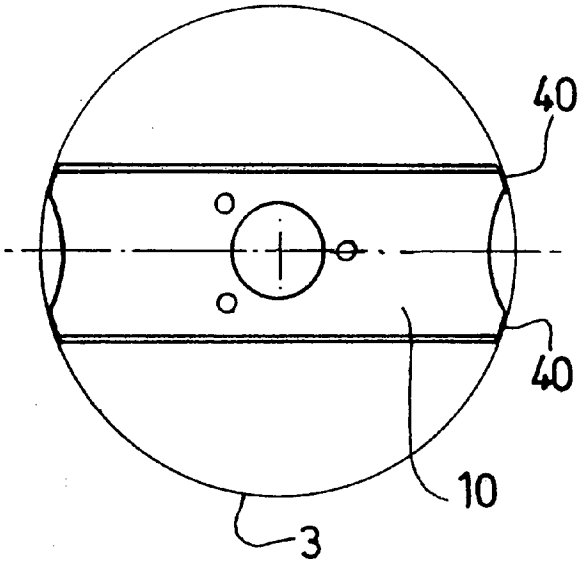
FIG. 8 is a plan view of an alternative form of embodiment of the bearing support.

As goes without saying, the invention is not restricted to the embodiment of this method of assembling a scroll compressor that has been described hereinabove by way of example; on the contrary, it encompasses all variant embodiments. Thus, in particular, as shown in FIG. 8, the zones of contact 40 between the bearing support 10 and the shell ring 3 are spot regions, the zones of contact 40 being arranged in a circle corresponding to the shell ring 3 in the conditions of use of the compressor.

The invention claimed is:

1. A method of assembling a refrigerating compressor comprising a sealed chamber laterally delimited by a shell ring, a drive shaft housed in the shell ring and guided with respect to the other components of the compressor by at least one bearing created in a bearing support attached to the to an interior wall of the shell ring, which method comprises the following steps consisting in:

supplying the shell ring which, in the plane of attachment of the bearing support, has a cross section of oval overall shape comprising a minor axis along which the bearing support is intended to be mounted, and a major axis, a length of the minor axis being less than a length of the bearing support measured along its longest dimension, applying pressure to the shell ring in order to deform it elastically in such a way as to increase the length of its minor axis, inserting the bearing support into the shell ring, positioning the bearing support in the plane of attachment thereof, along the minor axis of the shell ring, ceasing to apply pressure to the shell ring so that the latter has a tendency elastically to revert to its original shape and grips the bearing support, zones of contact between the bearing support and the shell ring lying more or less on an arc of a circle of a diameter greater than the minor axis, the bearing support maintaining elastic deformation of the shell ring so that the latter exhibits a substantially circular cross section in the plane of attachment of the bearing support.

2. The method of assembly as claimed in claim 1, wherein the bearing support is attached to the interior wall of the shell ring on a plane substantially perpendicular to the axis of the shell ring.

3. The method of assembly as claimed in claim 1, wherein the step that consists in supplying the shell ring of oval overall cross section comprises the following steps:

supplying the shell ring of substantially cylindrical shape, and permanently deforming the shell ring in such a way that it exhibits said cross section of oval overall shape in the plane of attachment of the bearing support.

4. The method of assembly as claimed in claim 1, wherein the pressure applied to the shell ring is applied along the major axis of the shell ring, on each side of the minor axis thereof.

5. The method of assembly as claimed in claim 1, which method comprises a step that consists in creating at least one spot weld between the bearing support and the shell ring after the former has been positioned in the latter.

6. The method of assembly as claimed in claim 1, which method comprises the following steps, performed before the bearing support is positioned in the shell ring, and consisting in:

attaching a stator of an electric motor inside the shell ring, the stator being mounted so that it is stationary with respect to the interior wall of the shell ring, attaching inside the shell ring a body that is intended to delimit an intake volume and a compression volume on each side thereof, a bearing intended to guide the drive shaft being created in the body, assembling the drive shaft in the bearing created in the body, attaching the rotor of the electric motor to the drive shaft.

7. The method of assembly as claimed in claim 1, which method comprises the following steps, performed after the bearing support has been positioned in the shell ring, and consisting in:

attaching a compression stage inside the shell ring, the compression stage comprising a fixed volute equipped with a scroll engaged in a scroll of a moving volute driven in an orbital movement, attaching a cover to one of the ends of the shell ring, attaching a base to the other end of the shell ring.

8. The method of assembly as claimed in claim 1, wherein the zones of contact between the bearing support and the shell ring are discontinuous.

9. A refrigerating compressor comprising:

a sealed chamber laterally delimited by a shell ring, an electric motor housed in the shell ring, the electric motor comprising a stator, and a rotor secured to a drive shaft, the drive shaft being guided with respect to the other components of the compressor by at least one bearing created in a bearing support attached to an interior wall of the shell ring, in which zones of contact between the bearing support and the shell ring lie more or less on an arc of a circle, and in which, when the bearing support is in a non-assembled position, the shell ring has, in the plane of attachment of the bearing support, an oval overall cross section comprising a minor axis along which the bearing support is intended to be mounted, a length of the minor axis being less than a diameter of the arc of a of the circle on which the zones of contact between the bearing support and the shell ring lie.

10. The refrigerating compressor as claimed in claim 9, wherein the zones of contact between the bearing support and the shell ring are discontinuous.

* * * * *